United States Patent [19]

Sproat

[11] 4,021,001

[45] May 3, 1977

[54] CORES FOR USE IN REELING UP SHEET MATERIALS

[75] Inventor: Alan Conrad Sproat, Dumfries, Scotland

[73] Assignee: Imperial Chemical Industries Limited, London, England

[22] Filed: Apr. 21, 1976

[21] Appl. No.: 678,879

[30] Foreign Application Priority Data

Apr. 22, 1975 United Kingdom ..... 16561/75

[52] U.S. Cl. ..... 242/68.5; 428/36; 428/516

[51] Int. Cl.[2] ..... B65H 75/40

[58] Field of Search ..... 242/68.5, 118.32, 118.7; 229/93; 428/36, 516; 138/151

[56] References Cited

UNITED STATES PATENTS

| | | | |
|---|---|---|---|
| 2,350,369 | 6/1944 | Sampair | 242/68.5 |
| 3,070,281 | 12/1962 | Durkin | 242/118.32 |
| 3,179,245 | 4/1965 | Bastion | 242/68.5 X |
| 3,643,888 | 2/1972 | Blue | 242/118.32 |

*Primary Examiner*—Edward J. McCarthy
*Attorney, Agent, or Firm*—Cushman, Darby & Cushman

[57] ABSTRACT

Cylindrical cores for use in reeling up sheet materials, (particularly thermoplastics films) are provided with a resiliently compressable outer surface region composed of layers of a resiliently compressable foamed synthetic material. The synthetic material is preferably a crystalline polyolefine, especially a blend of low and high density polyethylene.

8 Claims, 5 Drawing Figures

CORES FOR USE IN REELING UP SHEET MATERIALS

This invention relates to cores used in reeling up lengths of sheet materials such as plastics films, cloth or paper.

To facilitate storage and transport, a length of sheet material is often reeled up around a core which is usually a rigid paper tube or a cylinder generated by a plurality of longitudinally extending spaced parallel slats. A problem arises as a result of reeling up because even when made by a carefully controlled process, a length of sheet material particularly a length of oriented thermoplastics film will have longitudinally extending ridges and valleys owing to minute variations in thickness across its width. On reeling up the length, corresponding ridges and valleys on adjacent layers of sheet material coincide so that there is obtained a multitude of superimposed ridges resting one on top of another and separated transversely by a multitude of superimposed valleys which are spaced a little way apart from each other. This is harmful in sheet materials of the kind which have a tendency to shrink during storage. During storage the valleys are able to shrink because they are spaced apart and have room to shrink whereas the ridges rest on top of one another and do not have room to shrink. The ridges therefore become stretched relative to the valleys and this results in the formation of longitudinally extending regions of distortion known as "stretch (or pucker) lanes" which hinder the efficient feeding of the sheet material to high speed packaging machinery or printing presses.

This invention provides a core suitable for use in reeling up shrinkable sheet material, the core having an axially extending inner region which is form-stable and a resiliently compressable outer-surface region comprising layers of a resiliently compressable film of a foamed crystalline aliphatic polyolefin material permanently in place around the form-stable inner region. Shrinkable sheet materials reeled up on cores provided by this invention show a reduced tendency to form stretch lanes. The resiliently compressable film is made of a foamed polyolefin material which preferably has a density of from 5 to 50 and more specifically of from 8 to 30% of the density of the polyolefin material in the unfoamed condition. It is preferred that the foam be an open-cell foam since possibly the compression and resilience of the foam is assisted by the passage of the air in and out of the open-cells. The preferred thickness of the film is from 0.1 to 1mm, especially of from 0.4 to 0.7mm and preferably the film should have an air porosity of from (2 to 50 and particularly 15 to 30) $\times 10^{-2}$ ml ($cm^2$ .sec.cm head of water)$^{-1}$ as measured according to British Standard 2925.

Examples of useful resiliently compressable films of foamed aliphatic polyolefin materials are described in United Kingdom patent specification 1 220 053 (unamended version). By "aliphatic polyolefin material" is meant compositions comprising a polymer consisting of a major amount of a polymerised aliphatic mono-olefin such as ethylene or propylene. In particular blends comprising low density polyethylene (i.e., density below 0.94 g/$cm^3$) with from 10 to 40% (by weight based on the weight of the blend) of a more crystalline polyolefin such as high density polyethylene or polypropylene offer an attractive balance between resilience and compressability.

The cores used in reeling up sheet materials must be sufficiently form-stable to preserve their form during the time between their manufacture and their insertion into a reeling-up machine. Form stability is conferred upon the cores of this invention by their axially extending inner region. This inner region may consist of a conventional rigid paper tube which has the advantage of being light, cheap and already well known to the trade or it may be a cylinder generated by a plurality of longitudinally extending parallel slats which is also well known to the trade. The resiliently compressable outer surface region may be provided on the tube by reeling up a length of foamed film onto the tube and then permanently fixing the film onto the tube by glueing the outermost end edge of the length of foamed film down onto the layer of film immediately below the end edge. Preferably the length of foamed film used should be long enough to provide from 3 to 20 layers of film on the tube and to create a core having a radius which is from 1 to 5mm longer than the radius of the tube. The tube may alternatively be made of for example metal or thermoplastics materials instead of paper. If the core is a cylinder generated by slats, the slats may be aluminium or wooden slats fastened to a pair of axially spaced discs.

Alternatively the core may comprise an axially extending form-stable inner region consisting of inner layers of the resiliently compressable foamed film which have been made form-stable by coating or soaking them with an adhesive which dries to form a rigid structure. A water based starch adhesive may be used for this purpose. One possible method for making this type of core comprises reeling up a length of foamed film onto a lubricated polished metal core-former and coating the outwardly facing surface of each of at least the innermost layers of film with the adhesive as they are reeled onto the core-former. In this way the outwardly facing surface of a coated layer becomes adhesively bonded to the inwardly facing surface of the next layer so that at least the innermost layers become rigid when the adhesive dries and can be removed from the core-former in a form-stable state.

Preferred embodiments of the invention will now be described with reference to the drawings in which FIG. 1 is a side elevation of a cylindrical core.

Figure 1:
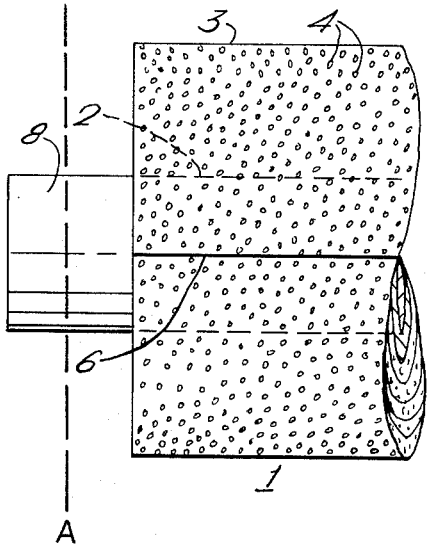

FIG. 1 shows a cylindrical core 1 having an axially extending form-stable inner region consisting of a rigid paper tube 2 and a resiliently compressable outer surface region 3 composed of layers 5 of a resiliently compressable film of an open-celled foamed blend of low density polyethylene with 20% by weight of high density polyethylene. The foam comprises open-cells 4 and has a density of 0.9 g/$cm^3$. The film is 0.6mm thick and is secured permanently in place around the tube by an axially extended strip of glue 7 which holds edge 6 in place.

Figure 3:
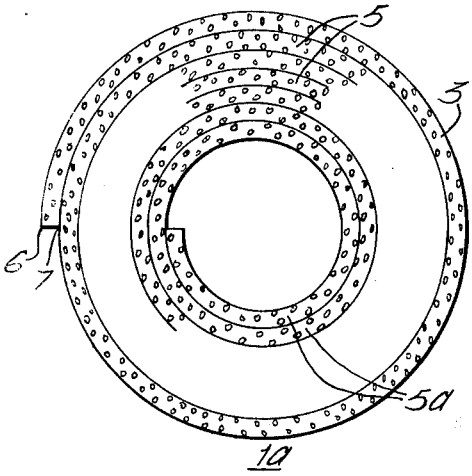
FIG. 3 is an end elevation in part diagrammatic of an alternative embodiment of a cylindrical core and is drawn on the same scale as FIG. 2.

FIG. 3 shows an alternative embodiment of a cylindrical core 1*a* in which tube 2 has been replaced by extra central layers 5*a* of the reeled up film of foamed polyethylene. Some of the open-cells of layers 5 and 5*a* are filled with a starch based adhesive which has dried to form a rigid structure and confer form stability on the inner region of cylindrical core 1*a*.

Figure 2:
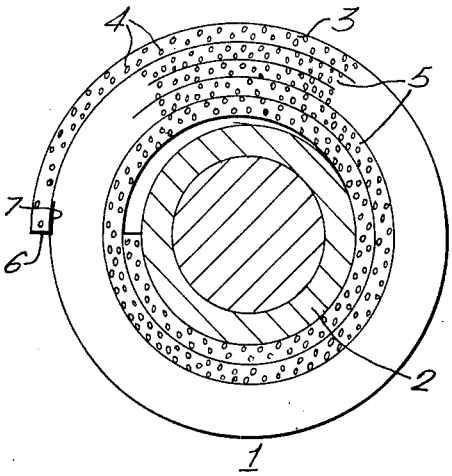
FIG. 2 is a section in part diagrammatic taken on the line A—A of FIG. 1 and drawn to a larger scale.

Polypropylene film was reeled up on cores as illustrated in FIGS. 1, 2 and 3 using an essentially surface winding technique. It was found that the tendency for stretch lanes to be formed in the polypropylene film was markedly reduced. Moreover the surface irregularity owing to edge 6 produced no ill effects on the film. This is in marked contrast to the behaviour of cores consisting solely of paper tubes where elaborate precautions have to be taken to ensure the paper tube has a highly smooth and regular surface. Paper tubes also have the disadvantage of shrinking during storage so that it is not uncommon for a paper tube to fall out of a reel of reeled up sheet material.

For the purposes of comparison, polypropylene film was reeled up on a modification of the core as shown in FIGS. 1 and 2 wherein the layers 5 of foamed polyethylene film were replaced by layers of open-celled polystyrene film. It was discovered that the use of the polystyrene film did nothing to alleviate the problem of stretch lanes.

Figure 5:
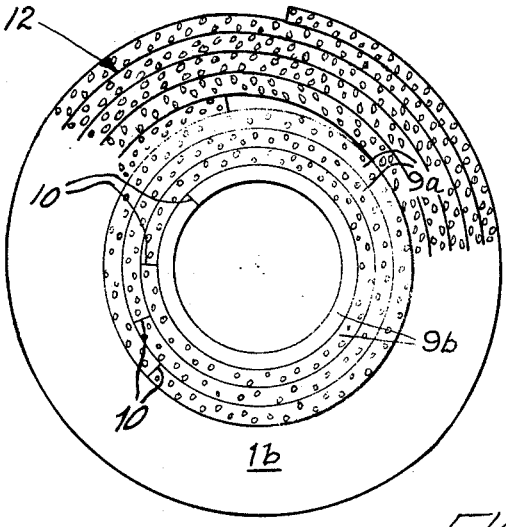
FIG. 5 is an end elevation of the core shown in FIG. 4 drawn to a larger scale and provided with a few turns of a sheet material.
Figure 4:
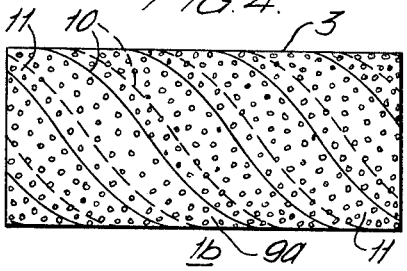
FIG. 4 is a scale elevation of a further embodiment of a cylindrical core and is drawn on the same scale as FIG. 1.

FIGS. 4 and 5 show an embodiment of a cylindrical core which is suitable for manufacture by a continuous process. Cylindrical core 1*b* is composed of concentrically and helically wound strips 9*a* and 9*b* of a film of opencelled foamed polyethylene. The strips 9*a* and 9*b* are wound in staggered fashion so that joins 10 between abutting edges of the strip do not coincide with similar joins 10 of the strip below. Some of the open-cells of strips 9*b* are filled with a rigid dried adhesive which confers form stability on strip 9*b* and hence in the axially extending inner region of core 1*b*. The loose ends 11 of strips 9*a* are glued in place by a strip of glue (not shown). A few turns of a film 12 of either a transparent oriented thermoplastics material or a heat shrinkable material are reeled up around the core 1b.

The helically wound structure of core *b* permits continuous production of the cores by helical winding techniques similar to those already used in the production of helically wound paper tubes. As the cores 16 can be produced continuously, they can be cut to a wide variety of different lengths as required.

This invention also provides a reel of shrinkable sheet material in which the sheet material is reeled up on a core of the kind hereinbefore disclosed.

I claim:

1. A core suitable for use in reeling up sheet material, the core having an axially extending form-stable inner region and permanently provided around said inner region a resiliently compressible outer surface region comprising layers of a resiliently compressible film of foamed crystalline aliphatic polyolefin material.

2. A core as claimed in claim 1 comprising from 3 to 20 layers of the resiliently compressible film.

3. A core as claimed in claim 2 wherein the film thickness of the film is from 0.1 to 1 mm.

4. A core as claimed in claim 3 wherein the density of the film of foamed material is from 5 to 50% of the density of the material in an unfoamed condition.

5. A core as claimed in claim 1 wherein the resiliently compressible foamed film is an open-celled foamed film.

6. A core as claimed in claim 5 wherein the film of a foamed crystalline polyolefin material is a film of polyethylene.

7. A reel of shrinkable material reeled up on a core as claimed in claim 1.

8. A reel of oriented thermoplastic material reeled up on a core as claimed in claim 1.

* * * * *